US006878684B2

(12) United States Patent
Ellson et al.

(10) Patent No.: US 6,878,684 B2
(45) Date of Patent: Apr. 12, 2005

(54) FABRIC CONDITIONING COMPOSITION

(75) Inventors: Karen Jane Ellson, Bebington (GB); Mansur Sultan Mohammadi, Bebington (GB)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 192 days.

(21) Appl. No.: 10/297,024

(22) PCT Filed: May 10, 2001

(86) PCT No.: PCT/EP01/05313

§ 371 (c)(1),
(2), (4) Date: Nov. 26, 2002

(87) PCT Pub. No.: WO01/92447

PCT Pub. Date: Dec. 6, 2001

(65) Prior Publication Data

US 2003/0171248 A1 Sep. 11, 2003

(30) Foreign Application Priority Data

May 26, 2000 (GB) ..... 0012958

(51) Int. Cl.[7] ..... C11D 1/835
(52) U.S. Cl. ..... 510/522; 510/527
(58) Field of Search ..... 510/522, 527

(56) References Cited

U.S. PATENT DOCUMENTS 5,726,144 A * 3/1998 Dewez et al. ..... 510/522
6,057,285 A 5/2000 Pescador et al.

FOREIGN PATENT DOCUMENTS

| | | | |
|---|---|---|---|
| EP | 0 060 003 A2 | | 9/1982 |
| GB | 1 599 171 | | 9/1981 |
| GB | 1 604 030 | | 12/1981 |
| JP | 63 295764 | | 12/1988 |
| WO | 94/14938 | | 7/1994 |
| WO | WO 97/16516 | * | 5/1997 |

OTHER PUBLICATIONS

Database WPI Derwent XP002177569 abstract of JP 63 295764 A—1 page.

International Search Report PCT/EP 01/05313 dated Sep. 28, 2001—4 pp.

UK Search Report GB 0012958.5 dated Aug. 7, 2000—1 page.

* cited by examiner

*Primary Examiner*—John R. Hardee
(74) *Attorney, Agent, or Firm*—Ellen Plotkin

(57) ABSTRACT

Fabric softening compositions with 1–10% by weight of cationic fabric softening compound show a surprising increase in viscosity when a fatty acid partial ester of a polyhydric alcohol at a level greater than 0.01% by weight and less than or equal to 0.45% by weight based on the composition is added and if the resulting mixture is sheared at a temperature below the phase transition temperature of the fabric softener composition. As a result, viscosities in the range 35–500 mPa·s at 106 $s^{-1}$ can be obtained in a surprising manner.

8 Claims, No Drawings

FABRIC CONDITIONING COMPOSITION

The present invention relates to a fabric conditioning composition, in particular a dilute fabric conditioning composition. The present invention further relates to a process for preparing a fabric conditioning composition, in particular a dilute fabric conditioning composition.

BACKGROUND OF THE INVENTION

Fabric conditioning compositions are commonly used to deposit a fabric softening compound onto fabric. Typically, such compositions contain a cationic fabric softening agent dispersed in water. Compositions containing softening agent below 5% by weight are considered ultra dilute. Compositions having around 5% softening agent are considered dilute, whilst softening agent levels in the range 5–10% by weight are termed semi dilute. Levels of softening agent from 10% to 50% by weight are considered concentrated. Dilute, ultra dilute and semi-dilute fabric conditioning compositions can suffer from problems of low viscosity. Consumers associate a high viscosity with good performance and product quality. A viscosity of at least 35 mPa·s at a shear rate of 106 $s^{-1}$ measured at ambient temperature is typically desirable.

The viscosity of ultra dilute, dilute and semi-dilute fabric conditioning compositions can be increased by including polymeric viscosity control agents, for example starches and cellulose ethers. However, these conventional viscosity control agents are expensive materials. They have to be included at levels in the range 0.05–1% by weight, which increases the costs of fabric conditioning compositions which include them. Furthermore, conventional polymeric viscosity control agents tend to show a drop in viscosity on storage. Further, they typically require a separate gelatinisation stage, in which they are mixed with water, which can increase the complexity and expense of the manufacturing process.

The present invention sets out to provide ultra dilute, dilute and semi dilute fabric conditioning compositions and processes for preparing them which achieve desirable viscosities without incorporating large quantities of expensive components.

The present inventors have discovered that a fatty acid partial ester of a polyhydric alcohol can act as a viscosity modifier, even when included at very low levels (for example below 0.2% by weight), if the fabric conditioning composition is manufactured under certain conditions. In particular, it is necessary to expose the fabric conditioning composition to shear at a temperature below the phase transition temperature of the fabric conditioning composition.

Fatty acid partial esters of polyhydric alcohols are themselves well known in fabric conditioning compositions. In particular, they are typically included as fabric softening components in their own right, for example as disclosed in EP-A-0000406 (Procter & Gamble); GB 1550205 (Procter & Gamble) and WO 97/16516 (Procter & Gamble).

WO 97/08285 (Colgate/Palmolive Company) discloses the use of fatty acid esters of mono or polyhydric alcohols as emulsion or dispersion stabilisers in fabric softening compositions containing 3–40% by weight of a fabric softener combination comprising an amido tertiary amine and an ester quat material. The weight ratio of fabric softener combination to fatty acid ester of mono or polyhydric alcohol is in the range 40:1 to about 5:1 and the level of fatty acid ester of mono- or polyhydric alcohol in the composition is in the range 0.2–2% by weight. There is no mention that lower levels of fatty acid ester of mono- or polyhydric alcohol can lead to unexpected increases in viscosity.

GB 2204608 (Kao Corporation) discloses liquid softener compositions comprising a quaternary ammonium salt, a polyamide and an ester derived from a fatty acid having 10–24 carbon atoms and glycerol, the weight ratio of quaternary ammonium salt to ester being in the range 0.1:1 to 3:1. There is, however, no mention of including a specific processing step in which the mixture is exposed to shear below the phase transition temperature of the system. There is no disclosure that the compositions can accordingly have unexpectedly high viscosities.

JP 63-295764 (Kao Corporation) discloses soft finishing agents containing (a) a cationic textile softening substance, (b) a straight chain fatty acid and (c) an esterified product of fatty acid and glycerol. The molar ratio of (b):(a) is 0.001 to 0.2, the weight ratio of (b):(a) is 0.01 to 3 and the total amount of (a), (b) and (c) is 3 to 20 wt %. There is no disclosure that stable thickening of compositions can be achieved through shear below the phase transition temperature of (a).

DE-A1-4400927 (Henkel) discloses aqueous solutions of quaternised fatty acid triethanolamine ester salts thickened by adding 0.01 to 0.1 wt % of esters of fatty acids with commercial oligoglycerol mixtures. There is no mention of mono-glycerol based viscosity modifies and no disclosure of a shearing step below the phase transition temperature of the system.

EP-A2-0060003 discloses concentrated textile treatment compositions comprising 12 to 25% of a water insoluble quaternary ammonium compound, a water soluble alkoxylated ammonium surfactant and a fatty acid ester of a polyhydric alcohol. There is no disclosure or teaching in relation to dilute compositions. Also page 7 of this document discloses a method of preparing the composition whereby the mixing clearly takes place above the phase transition temperature.

GB 1599171 (Procter & Gamble) discloses an aqueous textile treatment composition comprising a water insoluble cationic fabric softener, a water insoluble nonionic fabric softener and from 0.1 to 10 wt % of an aromatic carboxylic acid. The nonionic fabric softener is present in an amount from 0.5 to 12 wt %. There is no disclosure of the specific processing conditions of the present invention.

SUMMARY OF THE INVENTION

The present invention provides a fabric conditioning composition comprising an aqueous dispersion of:

(a) 1–10% by weight based on the total composition of cationic fabric softening compound, and (b) a partial ester of a fatty acid having 10–24 carbon atoms and a polyhydric alcohol as a viscosity modifier at a level greater than 0.01% by weight and less than or equal to 0.45% by weight based on the composition.

wherein the fabric conditioning composition has a dynamic viscosity in the range 35–500 mPa·s, measured at 106 $s^{-1}$ and 25° C. using Haake Rotoviscometer RV20, provided that when the alcohol radical component of the partial ester is based on glycerol, it is mono-glycerol.

The present invention further provides a process for preparing a fabric conditioning composition, comprising mixing with water:

(a) 1–10% by weight based on the total mixture of a cationic fabric softening compound, and (b) a partial ester of a fatty acid having 10–24 carbon atoms and a polyhydric alcohol as a viscosity modifier at a level greater than 0.01% by weight and less than or equal to 0.45% by weight based on the composition.

wherein the components are mixed together to form an aqueous dispersion, the aqueous dispersion being sheared at a temperature below the phase transition temperature of the dispersed phase.

Cationic Fabric Softening Compound

The fabric softening compound used in the present invention is cationic in nature. Preferably the cationic fabric softening compound of the invention has two long chain alkyl or alkenyl chains with an average chain length greater than C14. More preferably each chain has an average chain length greater than C16, must preferably at least 50% of the long chain alkyl or alkenyl groups have a chain length of C18 or more. Particularly preferred alkyl chains are derived from either tallow or palm fatty compounds.

It is preferred that the long chain alkyl or alkenyl groups of the cationic fabric softening compound are predominantly linear, i.e. have a low level of branching.

The cationic fabric softening compounds used in the invention are compounds which provide excellent softening, characterised by a chain melting Lβ to Lα transition temperature greater than 25° C., preferably greater than 35° C., most preferably greater than 45° C. This Lβ to Lα transition can be measured by differential scanning calorimetry (DSC) as defined in the "Handbook of Lipid Bilayers, D Marsh, CRC Press, Boca Raton Fla., 1990 (pages 137 and 337).

It is preferred that the cationic softening compound is substantially insoluble in water. Substantially insoluble fabric softening compounds in the context of this invention are defined as fabric softening compounds having a solubility less than $1\times10^{-3}$ wt % in demineralised water at 20° C. Preferably the fabric softening compounds have a solubility less than $1\times10^{-4}$ wt %, most preferably the fabric softening compounds have a solubility at 20° C. in demineralised water from $1\times10^{-6}$ to $1\times10^{-8}$ wt %.

Well known species of substantially water-insoluble quaternary ammonium compounds having the formula:

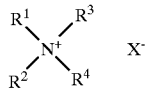

wherein $R^1$ and $R^2$ represent hydrocarbyl groups having from 12 to 24 carbon atoms; $R^3$ and $R^4$ represent hydrocarbyl groups containing 1 to 4 carbon atoms; and X is an anion, preferably selected from halide, methyl sulphate and ethyl sulphate radicals are preferred.

Representative examples of these quaternary softeners include di(tallow alkyl) dimethyl ammonium methyl sulphate; dihexadecyl dimethyl ammonium chloride; di(hydrogenated tallow alkyl) dimethyl ammonium chloride; dioctadecyl dimethyl ammonium chloride; di(hydrogenated tallow alkyl) dimethyl ammonium methyl sulphate; dihexadecyl diethyl ammonium chloride; di(coconut alkyl) dimethyl ammonium chloride, ditallow alkyl dimethyl ammonium chloride and di(hydrogenated tallow alkyl) dimethyl ammonium chloride (Arquad 2HT Trade Mark).

Other preferred softeners contain esters or amide links, for example those available under the trade names Accosoft 580, Varisoft 222, and Stepantex.

It is especially preferred that the cationic fabric softening compound is a water insoluble quaternary ammonium material which comprises a compound having two $C_{12-18}$ alkyl or alkenyl groups connected to the molecule via at least one ester link. It is more preferred if the quaternary ammonium material has two ester links present. The especially preferred ester-linked quaternary ammonium material for use in the invention can be represented by the formula:

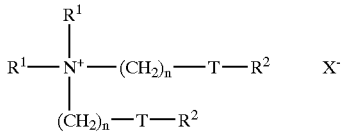

wherein each $R^1$ group is independently selected from C1–4 alkyl, hydroxyalkyl (e.g. hydroxyethyl) or C2–4 alkenyl groups; and wherein each $R^2$ group is independently selected from C8–28 alkyl or alkenyl groups;

T is

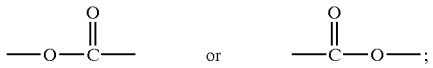

X— is any suitable anion and n is o or an integer from 1–5.

Preferred materials of this class include di-alkenyl esters of triethanol ammonium methyl sulphate and N-N-di (tallowoyloxy ethyl) N,N-dimethyl ammonium chloride. Commercial examples of compounds within this formula are TETRANYL (RTM) AOT-1 (di-oleic ester of triethanol ammonium methyl sulphate 80% active), TETRANYL A0-1 (di-oleic ester of triethanol ammonium methyl sulphate 90% active), TETRANYL L1/90 (partially hardened tallow ester of triethanol ammonium ethyl sulphate 90% active), TETRANYL L5/90 (palm ester of triethanol ammonium methyl sulphate 90% active and Tetranyl AHT-1 (hardened tallow ester of triethanol ammonium methyl sulphate 90% active), all ex Kao corporation) and REWOQUAT (TRM) WE15 ($C_{10}$–$C_{20}$ and $C_{16}$–$C_{20}$ unsaturated fatty acid reaction products with triethanolamine dimethyl sulphate quaternised 90% active), ex Witco Corporation.

A second preferred type of quaternary ammonium material can be represented by formula:

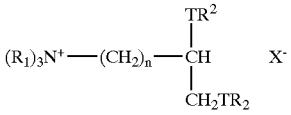

wherein $R^1$, $R^2$, T, $X^-$ and n are as defined above.

It is advantageous for environmental reasons that the quaternary ammonium material is biologically degradable.

Preferred materials of this class such as 1,2 bis[hardened tallowoyloxy]-3-trimethylammonium propane chloride and their method of preparation are, for example, described in U.S. Pat. No. 4,137,180 (Lever Brothers). Preferably these materials comprise small amounts of the corresponding monoester as described in U.S. Pat. No. 4,137,180 for example 1-hardened tallowoyloxy-2-hydroxy trimethylammonium propane chloride.

The fabric softening agent may also be a polyol ester quat (PEQ) as described in EP 0638 639 (Akzo).

If the quaternary ammonium softening compound comprises hydrocarbyl chains formed from fatty acids or fatty acyl compounds which are unsaturated or at least partially unsaturated (e.g. having an iodine value of from 5 to 140, preferably 5 to 100, more preferably 5 to 60, most preferably 5 to 40, e.g. 5 to 25), then the cis:trans isomer weight ratio in the fatty acid/fatty acyl compound is greater than 20/80, preferably greater than 30/70, more preferably greater than 40/60, most preferably greater than 50/50, e.g. 70/30 or greater. It is believed that higher cis:trans isomer weight ratios afford compositions comprising the compound better low temperature stability and minimal odour formation. Suitable fatty acids include Radiacid 406, ex Fina.

Saturated and unsaturated fatty acids/acyl compounds may be mixed together in varying amounts to provide a compound having the desired iodine value.

Fatty acids/acyl compounds may also be hydrogenated to achieve lower iodine values.

Of course, the cis:trans isomer weight ratios can be controlled during hydrogenation by methods known in the art such as by optimal mixing, using specific catalysts and providing high $H_2$ availability.

The present invention is found to be particularly effective for liposomal dispersions of the above mentioned fabric softening components. It is also particularly effective for dispersions containing unsaturated softener systems. It is particularly effective for systems including a fabric softening coactive, for example fatty acid (as discussed below).

The cationic fabric softening compound is preferably present at a level in the range 1.5–7.0% by weight, more preferably 2.0–5.5% by weight, e.g. 2.1 to 4.5% by weight based on the total weight of the composition.

Fatty Acid Partial Ester of Polyhydric Alcohol

The viscosity modifiers used herein are fatty acid partial esters of polyhydric alcohols having from 1 to about 24 carbon atoms in the hydrocarbon chain of the fatty acid. Preferably, the total number of carbon atoms in the ester is equal to or greater than 16 and at least one of the hydrocarbon radicals in the ester has 12 or more carbon atoms.

The acid portion of the fatty ester can be obtained from mono- or polycarboxylic acids having from 1 to about 24 carbon atoms in the hydrocarbon chain. Suitable examples of monocarboxylic acids include behenic acid, stearic acid, oleic acid, palmitic acid, myristic acid, lauric acid, acetic acid, propionic acid, butyric acid, isobutyric acid, valeric acid, lactic acid, glycolic acid and dihydroxyisobutyric acid. Examples of suitable polycarboxylic acids include: n-butylmalonic acid, isocitric acid, citric acid, maleic acid, succinic acids and mixtures thereof.

The alcohol radical in the fatty ester can be represented by polyhydric alcohols having from 1 to 24 carbon atoms in the hydrocarbon chain. Examples of suitable alcohols include: ethylene glycol, glycerol, xylitol, sucrose, erythritol, pentaerythritol, sorbitol, sorbitan or mixtures thereof.

If the alcohol radical of the fatty ester is based on glycerol, then it must be a monoglycerol radical and not a di or higher glycerol radical.

Preferred fatty esters are esters of a polyhydric alcohol such as ethylene glycol, glycerol, pentaerythritol and sorbitan wherein the fatty acid portion of the ester normally comprises a species selected from behenic acid, stearic acid, oleic acid, palmitic acid or myristic acid.

Of course, whilst the alcohol radical may react with a single acid group to form a mono-ester, it may also react with more than one acid group to form a di- or higher ester. In this case, the number of acid groups reacting with the alcohol radical will be limited by the number of hydroxy functions on the alcohol radical.

Specific examples of esters for use herein include: pentaerythritol monoleate or monostearate, sucrose monostearate, ethylene glycol monostearate and sorbitan esters. Suitable sorbitan esters include sorbitan monostearate, sorbitan palmitate, sorbitan monolaurate, sorbitan monomyristate, sorbitan monobehanate, sorbitan monoleate, sorbitan dilaurate, sorbitan distearate, sorbitan dibehenate, sorbitan di-or trioleate, and also mixed tallowalkyl sorbitan mono- and di-esters. Glycerol esters are equally highly preferred in the composition herein. These are the mono- or di-esters of glycerol and the fatty acids of the class described above. Glycerol monostearate, glycerol mono-oleate, glycerol monopalmitate, glycerol monobehenate, and glycerol distearate are specific examples of these preferred glycerol esters.

Glycerol monostearate is commercially available as, for instance, Estol 1474 (ex Uniqema), Kessco GMS (ex Akzo Nobel) and Cutina GMS (ex Cognis). In the commercially available products, a mixture of mono-, di- and tristearate is generally present in a typical weight ratio of 40–55:30–45:5–15 respectively. Though, of course, commercial products having higher levels of the mono-ester component (60% or more, more preferably 75% or more, e.g. 85% to 95%) are also suitable for use in the compositions of the present invention.

Sucrose polyesters may be used, for example as described in WO-A1-98/16538.

Preferred esters also have an HLB (hydrophilic/lipophilic balance) value in the range of about 0.5 to 5, more preferably from about 2 to 3.

These fatty esters are preferably incorporated into the composition at levels such that the weight ratio of the cationic fabric softener compound to fatty ester is in the range of from about 400:1 to about 10:1, more particularly from about 300:1 to about 30:1.

The fatty ester is present in an amount greater than 0.01% to 0.45% by weight, based on the total weight of the composition, more preferably from 0.02 to 0.25%, most preferably from 0.05 to 0.2% e.g. 0.07 to 0.18% by weight.

When the cationic fabric softening compound comprises fatty chains derived from tallow where the weight ratio of $C_{18}$ chains to $C_{16}$ chains is greater than 1:1, it is preferred that the fatty acid portion of the partial ester also comprises chains where the $C_{18}$:$C_{16}$ weight ratio is equal to or greater than 1:1, more preferably 1:2 or less. If the cationic fabric softening compound comprises fatty chains derived from palm where the $C_{18}$:$C_{16}$ weight ratio is less than 1, then the fatty acid portion of the partial ester should also preferably comprise chains where the $C_{18}$:$C_{16}$ weight ratio is less than 1:1, more preferably 2:1 or more. The inventors have found that by matching the fatty chain length weight ratios between the components in the manner described above surprising improvements in visco-stability of the compositions can be achieved.

Additional Stabilising Agents

The compositions of the present invention may contain optional additional stabilising agents.

Compositions of the invention may also contain nonionic stabilisers. Suitable nonionic stabilisers which can be used include the condensation products of $C_8$–$C_{22}$ primary linear alcohols with 10 to 25 moles more preferably 10 to 20, most preferably 15 to 20 moles of ethylene oxide. Use of less than 10 moles of ethylene oxide, especially when the alkyl chain is in the tallow range, leads to unacceptably high aquatic toxicity. In particular the following nonionic stabilisers are preferred:

Genapol T-110, Genapol T-150, Genapol T-200, Genapol C-200, Genapol C-100, Genapol C-150 all ex Hoechst, Lutensol AT18 ex BASF. Preferably the nonionic stabiliser has an HLB value of from 10 to 20, more preferably 12 to 20.

Preferably, the level of nonionic stabiliser is within the range of from 0.1 to 10% by weight, more preferably from 0.5 to 5% by weight, most preferably from 1 to 4% by weight e.g. from 1.1 to 3% by weight.

Additional Viscosity Control Agent

An additional viscosity control agent may be present but this is not generally necessary. Any viscosity control agent used with rinse conditioners is suitable for use with the present invention, for example biological polymers such as Xanthan gum (for example Kelco ex Kelsan and Rhodopol ex Rhodia), Guar gum (for example Jaguar ex Rhodia), starches and cellulose ethers. Synthetic polymers are useful viscosity control agents such as polyacrylic acid, poly vinyl pyrolidone, polyethylene, carbomers, cross linked polyacrylamides such as Acosol 880/882, polyethylene and polyethylene glycols.

Oil

Fabric conditioning compositions according to the present invention may include oil. The oil functions as a co-softener and lubricant and can improve ease of ironing and perfume longevity. It also has an effect on the physical form of the product. The oil may be a mineral oil, ester oil or a silicone oil. Natural oils, such as vegetable oils may also be included. They are preferably hydrophobic. Suitable oils include those in the Sirius range of mineral oils (Trade Mark) supplied by Silkolene. Preferably the oils are liquid at room temperature and are emulsified in the fabric conditioning compositions.

Oils are preferably present in an amount from 1 to 5% by weight, more preferably 1.5 to 4% by weight based on the total weight of the composition.

Other Ingredients

Fatty alcohols may be included as described in EP-A-0394133, as low temperature stabilising agents.

When included, fatty alcohols are preferably present at a level of from 0.1 to 1.5% by weight based on the total weight of the composition.

The composition can also contain coactives such as fatty acids, for example C8–C24 alkyl or alkenyl monocarboxylic acids, or polymeric carboxylic acids. Preferably, saturated fatty acid coactives are used.

The level of fatty acid material is preferably more than 0.1% by weight, more preferably more than 0.2% by weight, preferably less than 5%, more preferably less than 3%, e.g. less than 2% by weight. The weight ratio of fabric softening compound to fatty acid material is preferably from 10:1 to 1:10, preferably 10:1 to 1:1.

The composition can also contain one or more optional ingredients, selected from non-aqueous solvents, pH buffering agents, perfumes, perfume carriers, colorants, hydrotropes, antifoaming agents, opacifiers, and anticorrosion agents.

The composition of the present invention optionally includes an additional fabric treatment agent such as insect control agents, hygiene agents or compounds used to prevent the fading of coloured fabrics. Suitable fabric treatment agents are disclosed in WO 97/44424.

Electrolytes

The compositions of the present invention are preferably free of electrolytes (such as alkali metal halides). However, if they are present (e.g. as a minor ingredient in the raw material of the cationic surfactant), then they are preferably present at a level no greater than 0.03%, preferably 0.01%, more preferably no greater than 0.005% by weight based on the total weight of the composition.

Composition pH

The compositions of the invention preferably have a pH of at least 1.5, and/or less than 5, more preferably from 2.5 to 4.

Product Form

Compositions of the present invention are ultra dilute, dilute or semi dilute rinse fabric conditioning compositions for use in the rinse cycle of a laundry process, in particular the rinse cycle of a domestic or industrial laundry process.

The compositions are preferably present as an emulsion or dispersion or a mixture of these.

The compositions according to the present invention preferably have a dynamic viscosity in the range 35–140 mPa·s at 106 $s^{-1}$, preferably 40–120 mPa·s, more preferably 50–120 mPa·s. Most preferably, compositions according to the present invention have a dynamic viscosity in the range 70–1000 mPa·s at a shear rate of 20 $s^{-1}$.

Viscosities are suitably measured using a Haake Rotoviscometer (registered trade mark) RV20 at 25° C.

It is a particular advantage of the present invention that viscosities in this range can be achieved without the use of expensive additional viscosity control agents. According to a preferred embodiment of the present invention, additional viscosity control agents such as polymeric viscosity control agents other than the fatty acid partial esters of polyhydric alcohols are present at a level of less than 0.05% by weight, preferably less than 0.02% by weight.

It is also found that compositions according to the present invention have very stable viscosity on storage.

The products of the present invention may be liposomal dispersions of the dispersed phase in an aqueous continuous phase, oilosomal systems or emulsions, in which droplets of oil for example mineral oil are present as described in WO 99/43777 and EP-A-829531.

Processing

Preferably, in the process of the present invention, a cationic fabric softening compound is melted and mixed with optional additional ingredients such as fatty acid and stabilising surfactant if required. A homogeneous mixture is produced.

Separately, water or an aqueous solution of water-soluble components (if present, for example electrolyte) is prepared at elevated temperatures (suitably in the range 50–100, preferably 60–85° C.). The molten active mixture is added slowly to the aqueous solution with stirring, preferably with additional longitudinal shear generated using a recycling loop. After a few minutes, perfume (if required) is added slowly and the mixture is stirred slowly to ensure thorough mixing. The composition is cooled with continual stirring.

Once the dispersion has cooled to below the phase transition temperature of the dispersed phase, it is sheared.

Fabric conditioning compositions which comprise an aqueous dispersion of water insoluble cationic fabric softening compound exist at ambient temperature as a dispersion of lamellar droplets where the chains exist in a solid or crystalline state (Lβ) and as the temperature is raised above a certain point the dispersed phase undergoes a transition to a lamellar phase (Lα) where the chains of the cationic softener (with or without co-actives) will exist in a more fluid or liquid state. Shear must be carried out according to the present invention below this phase transition temperature. For some compositions, an intermediate (Lα and Lβ) phase may exist between a fully Lβ phase and a fully Lα phase. Shear must also be carried out below this intermediate phase. Thus, in the context of the present invention, "below the phase transition temperature of the dispersed phase" means below the lowest phase transition temperature of the fabric softening compound. Typically, this temperature is in the range 40–50° C. for cationic softeners with long (greater than $C_{18}$) saturated chains. Preferably, shear is carried out at a temperature in the range 25–50° C. more preferably 30–50° C., e.g. 40–50° C. for these cationic softeners. For softeners comprising partially saturated or unsaturated chains, lower temperatures in the range 25–50° C. are preferred, e.g. 25 to 40° C.

Shearing can be carried out in any suitable apparatus, for example a Silverson (trade name) Mixer or a Janke and Kunkel (trade name) high shear Mixer.

The level and duration of shear can be used to control the viscosity of the finished product.

EXAMPLES

The present invention will be further described by way of example only with reference to the accompanying examples.

All quantities are parts or % by weight of the active ingredient unless indicated otherwise.

Examples of the invention are denoted by a number and comparative examples by a letter.

Method

Fabric softening compositions comprising quaternary ammonium fabric softening compounds were produced by the following method.

Fabric softening actives comprising cationic fabric softener and fatty acid were melted together. The molten actives were mixed with water at 75° C. Molten actives were added to the water at a rate of approximately 2% by weight per minute. The mixture was stirred at 204 rpm. For added shear, the mixture was pumped through a circulating loop at a rate of approximately one batch volume every 10 minutes.

Initial pumping and stirring was carried out for 15 minutes, after which the composition was cooled using a jacketed vessel for 10 minutes. Examples according to the invention were then subjected to shear by being milled at a temperature below the phase transition temperature of the dispersion. In practice, milling was carried out at 40° C. Milling was carried out for a further 10 minutes, whilst cooling continued. Perfume was added after the milling stage, when the temperature had reached 40° C. and the sample was tapped off when the temperature reached 30° C.

In all cases, milling was carried out using a Janke & Kunkel shear mixer at half power.

In the comparative examples A and B, the composition was stirred and pumped for 5 minutes before being milled in the same apparatus for a further 10 minutes at 75° C. Cooling was carried out after milling. Perfume was added when the temperature had reached 40° C. and the sample was tapped off when the temperature reached 30° C.

Initial Viscosity; Examples 1–4, A and B

Tables 1a and 1b below show the initial viscosity results for a number of examples according to the invention and comparative examples.

The resulting products were tested to measure their viscosity at 20 $s^{-1}$ and 106 $s^{-1}$ using a Haake Rotoviscometer (trade mark) RV20.

TABLE 1a

| | Example 1 | Example 2 | Example 3 |
|---|---|---|---|
| Quat type of which: | DEEDMAC | DEEDMAC | DEEDMAC |
| Cationic | 3.42% | 3.42% | 3.42% |
| Fatty acid | 0.08% | 0.08% | 0.08% |
| Total Active | 3.5% | 3.5% | 3.5% |
| Tallow alcohol | 1.23% | 1.23% | 1.23% |

TABLE 1a-continued

| | Example 1 | Example 2 | Example 3 |
|---|---|---|---|
| Coco 20 EO | — | — | — |
| GMS | 0.1% | 0.05% | 0.02% |
| Tegosoft PSE 141G | — | — | — |
| Added tallow fatty acid | — | — | — |
| Perfume | 0.32% | 0.32% | 0.32% |
| Quat:fatty acid ratio | 85.5:2 | 85.5:2 | 85.5:2 |
| Milling temp | 40° C. | 40° C. | 40° C. |
| Viscosity @ 20 $s^{-1}$ | 353 mPa · s | 370 mPa · s | 369 mPa · s |
| Viscosity @ 160 $s^{-1}$ | 121 mPa · s | 127 mPa · s | 106 mPa · s |

TABLE 1b

| | Comparative Example A | Example 4 | Comparative Example B |
|---|---|---|---|
| Quat type of which: | DEEDMAC | DEEDMAC | DEEDMAC |
| Cationic | 3.42% | 3.42% | 3.42% |
| Fatty acid | 0.08% | 0.08% | 0.08% |
| Total Active | 3.5% | 3.5% | 3.5% |
| Tallow alcohol | 1.23% | 1.23% | 1.23% |
| Coco 20 EO | — | — | — |
| GMS | 0.1% | — | — |
| Tegosoft PSE 141G | — | 0.1% | 0.1% |
| Added tallow fatty acid | — | — | — |
| Perfume | 0.32% | 0.32% | 0.32% |
| Quat:fatty acid ratio | 85.5:2 | 85.5:2 | 85.5:2 |
| Milling temp | 75° C. | 40° C. | 75° C. |
| Viscosity @ 20 $s^{-1}$ | 21 mPa · s | 1150 mPa · s | 32 mPa · s |
| Viscosity @ 160 $s^{-1}$ | 7 mPa · s | 280 mPa · s | 21 mPa · s |

Comparison of Example 1 with Comparative Example A shows that an inclusion of 0.1% of GMS followed by shearing at a temperature at 40° C. leads to very large and unexpected increase in viscosity both at 20 $s^{-1}$ and 106 $s^{-1}$.

Example 4 and Comparative Example B demonstrate the same effect for a different partial ester of polyhydric alcohol.

In the tables:

Added tallow fatty acid is Pristerine 4916, a hardened tallow acid, available from Uniqema.

Tallow alcohol is Laurex 18, a hardened tallow alcohol, available from Albright and Wilson.

"coco 20EO" is Genapol 200, a coconut alcohol ethoxylated with 20 moles of ethylene oxide, obtainable from Clariant.

GMS is glycerol monostearate obtainable from BDH

Tegosoft PSE 141G is a sucrose monostearate mixed with tallow alcohol/coconut alcohol, obtainable from Goldschmidt.

Deedmac is di[2-(hardened tallowoyloxy)ethyl]dimethyl ammonium chloride, obtainable from Witco. The raw material comprises the cationic and fatty acid in a weight ratio of 42.75:1.

Viscosity Stability Upon Storage; Examples 1–3 and A

Compositions according to the present invention have an unexpected viscosity stability. This was demonstrated by measuring the viscosity of the compositions set out above after storage for a number of days under various temperatures. The results are set out in Tables 2, 3 and 4.

The viscosities were measured at 25° C. using a Haake Rotoviscometer RV20. The results are given as mPa·s.

TABLE 2

ROOM TEMPERATURE STORAGE

| Number of days | Shear rate | Example 1 | Example 2 | Example 3 | Comparative Example A |
|---|---|---|---|---|---|
| 0 | 20 $s^{-1}$ | 353 | 370 | 369 | 21 |
| | 106 $s^{-1}$ | 121 | 127 | 106 | 7 |
| 7 | 20 $s^{-1}$ | 321 | — | — | 7 |
| | 106 $s^{-1}$ | 104 | — | — | 4 |
| 14 | 20 $s^{-1}$ | 285 | — | — | 4 |
| | 106 $s^{-1}$ | 95 | — | — | 2 |
| 21 | 20 $s^{-1}$ | — | 482 | 244 | — |
| | 106 $s^{-1}$ | — | 106 | 78 | — |
| 28 | 20 $s^{-1}$ | 290 | 647 | 272 | — |
| | 106 $s^{-1}$ | 91 | 156 | 87 | — |
| 42 | 20 $s^{-1}$ | — | 700 | 250 | — |
| | 106 $s^{-1}$ | — | 170 | 85 | — |
| 49 | 20 $s^{-1}$ | — | 750 | 255 | — |
| | 106 $s^{-1}$ | — | 187 | 87 | — |
| 56 | 20 $s^{-1}$ | 269 | — | — | — |
| | 106 $s^{-1}$ | 86 | — | — | — |
| 63 | 20 $s^{-1}$ | — | 802 | 261 | — |
| | 106 $s^{-1}$ | — | 198 | 89 | — |

TABLE 3

37° C. STORAGE

| Number of days | Shear rate | Example 1 | Example 2 | Example 3 | Comparative Example A |
|---|---|---|---|---|---|
| 0 | 20 $s^{-1}$ | 353 | 370 | 369 | 21 |
| | 106 $s^{-1}$ | 121 | 127 | 106 | 7 |
| 7 | 20 $s^{-1}$ | 320 | — | — | 9 |
| | 106 $s^{-1}$ | 102 | — | — | 4 |
| 14 | 20 $s^{-1}$ | 280 | — | — | 2 |
| | 106 $s^{-1}$ | 94 | — | — | 2 |
| 21 | 20 $s^{-1}$ | — | 332 | 197 | — |
| | 106 $s^{-1}$ | — | 84 | 70 | — |
| 28 | 20 $s^{-1}$ | 285 | 351 | 221 | — |
| | 106 $s^{-1}$ | 84 | 82 | 71 | — |
| 42 | 20 $s^{-1}$ | — | 360 | 250 | — |
| | 106 $s^{-1}$ | — | 84 | 75 | — |

TABLE 4

4° C. STORAGE

| Number of days | Shear rate | Example 1 | Example 2 | Example 3 | Comparative Example A |
|---|---|---|---|---|---|
| 0 | 20 $s^{-1}$ | 353 | 370 | 369 | 21 |
| | 106 $s^{-1}$ | 121 | 127 | 106 | 7 |
| 7 | 20 $s^{-1}$ | 314 | — | — | 9 |
| | 106 $s^{-1}$ | 102 | — | — | 4 |
| 14 | 20 $s^{-1}$ | 306 | — | — | 2 |
| | 106 $s^{-1}$ | 104 | — | — | 2 |
| 21 | 20 $s^{-1}$ | — | 388 | 262 | — |
| | 106 $s^{-1}$ | — | 93 | 81 | — |
| 28 | 20 $s^{-1}$ | 275 | 541 | 315 | — |
| | 106 $s^{-1}$ | 69 | 130 | 97 | — |
| 42 | 20 $s^{-1}$ | — | 580 | 330 | — |
| | 106 $s^{-1}$ | — | 140 | 101 | — |

It can be seen that the increase in viscosity obtained by the present invention is retained during storage.

Initial Viscosity; Example 5 and Comparative Example C

Two emulsion-type rinse conditioner compositions were produced. One was sheared at temperature at below the phase transition temperature of the dispersed phase (Example 5) and the other was sheared at high temperature (Example C). For comparison, Comparative Example C also includes a conventional polymeric cationic starch polymer thickener (Softgel BDA).

Table 5 below shows the viscosities (mPa·s) of the composition before and after shear.

TABLE 5

| Components | Example 5 | Comparative Example C |
|---|---|---|
| Arquad 2HT | 2.20* | 2.20* |
| Sirius M180 | 2.14 | 2.14 |
| Hard tallow fatty acid | 0.29 | 0.29 |
| GMS | 0.25 | — |
| Softgel BDA | — | 0.25 |
| Perfume | 0.20 | 0.20 |
| Product viscosity before shear | | |
| at 20 $s^{-1}$ | 41 | 77 |
| at 106 $s^{-1}$ | 19 | 45 |
| Viscosity after shear by Silverson | | |
| at 20 $s^{-1}$ | 291 | 24 |
| at 106 $s^{-1}$ | 69 | 17 |

Arquad 2HT is di-hardened tallow di-methyl ammonium chloride (ex Hoechst). The raw material is provided as 80% active, with 20% IPA as solvent.
*% by weight of active.
Sirius M180 is a white mineral oil (ex Silkolene),
Hard tallow fatty acid is Pristerine 4916 (ex Uniqema).
Softgel BDA is a cationic starch polymer (ex Avebe).
GMS is described above.

It can be seen that, whereas the composition of Example 5 has an unacceptable viscosity before shearing, its viscosity becomes very good after shearing. In contrast, Comparative Example C shows acceptable viscosity before shear because of the presence of the starch based polymer, but loses the viscosity after shearing.

Initial Viscosity; Example 6 and Comparative Example D

Formulations having the compositions set out in Table 7 were manufactured by the route defined below.

Tetranyl AT-7590 is a triethanol amine quaternary ammonium compound available from Kao containing 10% by weight IPA as solvent. It is manufactured with partially saturated tallow with an iodine value of 34.

Sugar ester oil (ER290) is sucrose tetraerucate, obtainable as Ryoto ER290 ex Mitsubishi-Kasei.

All samples are produced at the 200 ml scale.

The TEA quat was melted and slowly added to the water in the vessel at the process temperature. After 5 minutes, the perfume was added, followed by dye and preservative.

The composition was then subjected to milling at the shear set out below. Table 8 sets out the viscosity obtained in mPa·s. It can be observed that Comparative Example D provides a much lower viscosity than Example 6. This demonstrates that much higher viscosities can be obtained by shearing below the phase transition temperature (which is about 30° C. in this system).

Compositions were sheared using a Silverson multipurpose mixer obtained from Silverson Machine Limited with a square hole head, set at the lowest speed. Compositions were milled for 1 minute.

TABLE 6

| Materials | Comparative example D | Ex 6 |
|---|---|---|
| Tetranyl AT-7590 (90%) | 4.52 | 4.52 |
| Sugar ester oil (ER290) | 0.45 | 0.45 |
| Perfume | 0.32 | 0.32 |
| Dye patent blue (1% solution) | 0.06 | 0.06 |
| Preservative | 0.08 | 0.08 |
| Demin water balance to 100% | balance | Balance |
| Process temp ° C. | 46 | 25 |

TABLE 7

| Example | Comparative example D | Ex 6 |
|---|---|---|
| Viscosity before milling (20, 106 $s^{-1}$) | 6, 3 | 45, 22 |
| Viscosity after milling (20, 106 $s^{-1}$) | 6, 4 | 84, 33 |

Initial Viscosity; Examples 7–11

The following compositions were produced at the 3.5 kg scale. The quaternary ammonium material, oil and coactives were melted and slowly added to the water in the vessel at 45° C. After 10 minutes mixing, the sample was then cooled to 40° C. and the perfume was added, the sample was milled for the stated time. The viscosities were then measured.

TABLE 8

| Ingredient/Example | Ex 7 | Ex 8 | Ex 9a, 9b | Ex 10 | Ex 11 |
|---|---|---|---|---|---|
| Arquad 2HT | 2.2 | 2.2 | 2.2 | 2.2 | 2.2 |
| Semtol 70/28 mineral oil | 3.3 | 3.3 | 3.3 | 3.3 | 3.3 |
| Pristerine 4981 fatty acid | 0.0 | 0.37 | 0.37 | 0.37 | 0.38 |
| Laurex tallow alcohol | 0 | 0 | 0 | 0.37 | 0 |
| Perfume (soft touch MOD 178) | 0.32 | 0.32 | 0.32 | 0.32 | 0.32 |
| GMS | 0.05 | 0.05 | 0.1 | 0.05 | 0.2 |
| Minutes milling (Janke & Kunkel high shear mixer half power) | 5 | 5 | 5, 2.5 | 5 | 5 |
| Viscosity at 20 $s^{-1}$ (mPa · s) | 220 | 250 | 380, 200 | 460 | 307 |
| Viscosity at 106 $s^{-1}$ (mPa · s) | 75 | 90 | 105, 70 | 220 | 84 |

Arquad 2HT is described above.
The fatty acid is obtainable from Uniqema. It is a hardened tallow fatty acid.
The tallow alcohol is described above.
The mineral oil is obtainable from Witco.
GMS is described above.

Initial Viscosity; Examples 12–14 and Comparative Examples E–G

The following compositions were produced at the 3.5 kg scale. The Deedmac and coactives were melted and slowly added to the water in the vessel at 75° C. After 10 minutes, the sample was cooled to 40° C. and the perfume added. The sample was then milled for the stated time either above (hot milling) or below (cold milling) the phase transition temperature. Viscosity (mPa·s) was then measured using a Haake Rotoviscometer RV20 at 25° C. The results are shown in Table 9 below.

TABLE 9

| Ingredient/Example | Ex E | Ex 12 | Ex F | Ex 13 | Ex G | Ex 14 |
|---|---|---|---|---|---|---|
| DEEDMAC (quat + fatty acid) | 3.5 | 3.5 | 3.5 | 3.5 | 3.5 | 3.5 |
| Laurex tallow alcohol | 1.23 | 1.23 | 1.23 | 1.23 | 1.23 | 1.23 |
| Tegosoft PSE 141G | 0.1 | 0.1 | 0 | 0 | 0 | 0 |
| Ryoto ER290 sucrose ester | 0 | 0 | 0.1 | 0.1 | 0.05 | 0.05 |
| Perfume (Softline DM53) | 0.32 | 0.32 | 0.32 | 0.32 | 0.32 | 0.32 |
| Hot milling | 10 min | 0 | 10 min | 0 | 10 min | 0 |
| Cold milling | 0 | 10 min | 0 | 10 min | 0 | 10 min |
| Viscosity at 20 $s^{-1}$ | 32 | 1050 | 38 | 1865 | 35 | 900 |
| Viscosity at 106 $s^{-1}$ | 21 | 280 | 25 | 340 | 20 | 206 |

The DEEDMAC raw material is the same as used in the previous examples (weight ratio of quat to fatty acid of 42.75:1).
The tallow alcohol, tegosoft PSE 141G and Ryoto ER290 are all described above.

Fabric Softening Effect

The fabric softening effect of the compositions was assessed by the following technique. Softening performance is evaluated by adding to 1 ltr of demineralised water at ambient temperature in a Tergotometer enough product to give 0.1 g of active softener material. In this way, the level of active softener was equal in the rinse liquor for all examples according to the invention. Three pieces of terry towelling (19 cm×19.5 cm weighing 40 g in total) were added to the Tergotometer pot. The terry towelling was already rinsed in a 0.00045% by weight sodium alkyl benzene sulphonate solution to simulate the anionic carry-over of detergent from a main wash. The towels were treated for 5 minutes at 65 rpm, spin-dried to remove excess liquor and line-dried overnight. A panel of 20 trained people evaluated the towels by comparing against set standards. A low number indicates a greater degree of softness (2 is very soft and 8 is harsh). In order to investigate the consistency of the results, the softness measurement was repeated under the same conditions, to give two results for each composition. Further, for control, an experiment to measure the softening obtained in a parallel experiment with the same source of water was conducted using dilute COMFORT (Trade Mark), a premium conventional fabric conditioner composition obtained from Thailand in February 2000. The control contained 3.8% by weight of cationic softening compound. The results are given in the following table.

TABLE 10

| | Example | | | |
|---|---|---|---|---|
| | 7 | 9a | 9b | Control |
| Softening Score | 4.00 | 4.4 | 3.13 | 3.375 |

The softening results demonstrate that for the compositions according to the invention, softening is generally comparable to that provided by a premium conventional fabric softener.

Perfume Effect

The capacity of fabric softening compositions according to the present invention to deliver a perfume to washed fabrics was assessed by the following method. Perfume delivery was evaluated by rinsing in a Tergotometer three pieces of terry towelling (19×19.5 cm weighing 40 g in total) per product in a similar manner to that previously described for softening evaluation above. Instead of being line-dried the cloths were immediately assessed for perfume intensity by a trained group of twenty panellists who ranked each cloth on a scale of zero to five corresponding to descriptors ranging from no perfume (zero) to very strong perfume (five). Further assessments were made after five hours when the cloths were dry and again after twenty-four hours or longer. The level of product was 0.1 g/l active matter with a perfume level in the rinse liquor of 4.76 mg/l.

The results are shown below in Table 11.

TABLE 11

| | Zero anionic carryover | | Standard anionic carryover (1 ml of 1% LAS solution) | |
|---|---|---|---|---|
| | Initial | 24 hours | Initial | 24 hours |
| Example 1 | 3.26 | 0.65 | 2.80 | 0.69 |
| Example 2 | 3.61 | 0.86 | 3.70 | 0.87 |
| Example 3 | 3.55 | 0.83 | 3.24 | 0.67 |
| Comparative Example A | 3.40 | 0.93 | 3.33 | 0.98 |

It can be seen that the compositions according to the present invention have greater or comparable perfume delivery compared to Comparative Example A, which represents the standard of performance of conventional fabric softening compositions.

The invention has been described above by way of example only and modifications can be made within the invention.

What is claimed is:

1. A process for preparing a fabric conditioning composition, comprising mixing water with:

(a) 1–10% by weight of a cationic fabric softening composition based on the total mixture, and (b) a fatty acid partial ester of a polyhydric alcohol at a level greater than 0.01% by weight and less than or equal to 0.45% by weight based on the composition, wherein the aqueous dispersion is sheared at a temperature below the phase transition temperature of the dispersed phase.

2. The process according to claim 1, wherein said composition further comprises a fatty acid.

3. The process according to claim 2, wherein said fatty acid is present in an amount of more than about 0.1% to less than about 5% by weight of said composition.

4. The process according to claim 2, wherein the weight ratio of component (a) to said fatty acid is from 10:1 to 1:10.

5. The process according to claim 1, wherein said fabric conditioning composition comprises about 2.0 to about 5.5% by weight of component (a).

6. The process according to claim 1, wherein said component (b) is a fatty acid partial ester of glycerol.

7. The process to claim 6, wherein said component (b) comprises glycerol monostearate.

8. The process according to claim 1, wherein said component (a) is a quaternary ammonium compound.

* * * * *